US008230604B1

(12) United States Patent
Corey et al.

(10) Patent No.: US 8,230,604 B1
(45) Date of Patent: Jul. 31, 2012

(54) PASTRY PRESS

(76) Inventors: Caprice G. Corey, Colinton (CA); David Thompson, Colinton (CA)

( * ) Notice: Subject to any disclaimer, the term of this patent is extended or adjusted under 35 U.S.C. 154(b) by 461 days.

(21) Appl. No.: 12/455,254

(22) Filed: May 29, 2009

Related U.S. Application Data

(60) Provisional application No. 61/130,038, filed on May 29, 2008.

(51) Int. Cl.
*B26F 1/40* (2006.01)
*B25G 1/00* (2006.01)

(52) U.S. Cl. ..... 30/358; 30/301; 30/316; 30/342

(58) Field of Classification Search ..... D7/672–677; 30/280, 301–303, 314–316, 167, 168, 358, 30/359, 366, 342, 114; 426/503, 518
See application file for complete search history.

(56) References Cited

U.S. PATENT DOCUMENTS

| | | | | | |
|---|---|---|---|---|---|
| 1,486,810 | A | * | 3/1924 | Stauffer | 30/301 |
| 1,618,685 | A | * | 2/1927 | Stauffer | D7/672 |
| 2,077,014 | A | | 4/1937 | Samuel | |
| 2,119,260 | A | * | 5/1938 | Valle | D7/675 |
| 2,206,316 | A | * | 7/1940 | Bartholomew | 30/302 |
| 2,214,475 | A | | 9/1940 | Napolillo | |
| 2,478,571 | A | * | 8/1949 | Creider | 30/301 |
| 2,618,852 | A | | 11/1952 | Clough | |
| 2,681,625 | A | * | 6/1954 | Babbitt | 30/301 |
| 2,779,097 | A | * | 1/1957 | Frazier | D7/672 |
| 2,968,261 | A | | 1/1961 | Tonkin | |
| 3,166,027 | A | | 1/1965 | Sprenzel | |
| D203,612 | S | * | 2/1966 | Waller, Jr. | D7/677 |
| 3,322,074 | A | | 5/1967 | Malnory | |
| 3,933,315 | A | * | 1/1976 | Popeil | 30/315 |
| 3,965,574 | A | * | 6/1976 | Graves | 30/358 |
| 4,010,543 | A | * | 3/1977 | Nusbaum | 30/316 |
| 4,327,489 | A | * | 5/1982 | Conrad | D7/676 |
| 4,345,516 | A | | 8/1982 | Sinclair | |
| 4,384,838 | A | | 5/1983 | Laughlin | |
| 4,442,604 | A | * | 4/1984 | Altman | 30/302 |
| 4,522,580 | A | | 6/1985 | Poister | |
| 4,572,444 | A | * | 2/1986 | Shadduck | 30/316 |
| D282,893 | S | | 3/1986 | Daenen | |
| 4,681,000 | A | * | 7/1987 | Wolters | 30/316 |
| 4,689,885 | A | * | 9/1987 | Albanese | 30/316 |
| 4,789,555 | A | * | 12/1988 | Judd | 426/503 |
| D303,474 | S | | 9/1989 | Wolff | |
| D304,403 | S | | 11/1989 | Wolff | |
| D307,371 | S | | 4/1990 | D'Orlando | |
| D311,117 | S | | 10/1990 | Wolff | |
| D337,703 | S | * | 7/1993 | Fox, Sr. | D7/675 |
| 5,303,473 | A | | 4/1994 | Sadler | |
| D347,976 | S | * | 6/1994 | Lombardi | D7/676 |
| D349,015 | S | * | 7/1994 | Kaiser | D7/675 |
| 5,662,010 | A | * | 9/1997 | Barnett | 30/315 |
| 5,720,991 | A | * | 2/1998 | Gildersleeve et al. | 30/302 |
| D401,482 | S | * | 11/1998 | De Are | D7/677 |

(Continued)

*Primary Examiner* — Jason Daniel Prone
(74) *Attorney, Agent, or Firm* — Montgomery Patent & Design, LLC; Robert C. Montgomery; Joseph T. Yaksich

(57) ABSTRACT

A pie dough cutter comprising a removably attachable handle providing decorative patterns to be added to the top of a pie crust is herein disclosed. The dough cutter comprises different designs for stamping a portion of crust providing decorative elements. After a pie crust is prepared a desired decorative pattern is pressed through the dough, which is then placed onto a pie prior to baking.

11 Claims, 5 Drawing Sheets

U.S. PATENT DOCUMENTS 5,983,503 A * 11/1999 DiMaulo ..... 30/303
6,276,918 B1 * 8/2001 Slaughter et al. ..... 30/303
6,381,852 B1 5/2002 Wallays et al.
6,851,192 B2 * 2/2005 So ..... 30/306
6,874,237 B2 * 4/2005 Robitaille ..... 30/315
D629,661 S * 12/2010 Lion et al. ..... D7/672
2004/0211069 A1 * 10/2004 Tuttle ..... 30/302
2005/0274242 A1 * 12/2005 McMahon et al. ..... 30/315
2007/0271796 A1 * 11/2007 Oikarinen et al. ..... 30/167
2008/0110031 A1 * 5/2008 Kolz ..... 30/299
2008/0209737 A1 * 9/2008 Storms ..... 30/114
2011/0283548 A1 * 11/2011 White ..... 426/518

* cited by examiner

PASTRY PRESS

RELATED APPLICATIONS

The present invention was first described in and claims the benefit of U.S. Provisional Application No. 61/130,038, filed May 29, 2008, the entire disclosures of which are incorporated herein by reference.

FIELD OF THE INVENTION

The present invention relates generally to pastry dough presses, and more particularly, to a pie crust cut-out press with a plurality of interchangeable cutting blades capable of creating various decorative effects.

BACKGROUND OF THE INVENTION

Pies are a favorite dessert due to the taste, texture, wide variety available and "sweet-tooth" appeal. Many bakers often add decorative touches to the upper pie crust before baking to increase the aesthetic appeal of the pie. These touches may be a letter to indicate the type of pie, or may be elaborate lattice work. In any case, the decorative pattern forms a signature trademark which distinguishes one (1) baker's pie from another.

Cutting devices for pastry dough is well known, generally taking the form of a walled body forming a closed hollow shape and an engaging handle. The hollow shape is pressed into the dough and the dough is cut into a shape corresponding to the figure made by the walled cutter. Various attempts have been made to provide dough forming and cutting devices as seen in several U.S. Patents, including U.S. Pat. Nos. 2,077,014, issued in the name of Samuel, which describes a culinary device; 2,214,475, issued in the name of Napolillo, which describes a dough cutter; 2,618,852, issued in the name of Clough, which describes a pie top cutter; 2,968,261, issued in the name of Tonkin, which describes a pie crust and other dough stock templates; 3,166,027, issued in the name of Sprenzel, which describes a dough forming and sizing device; 3,322,074, issued in the name of Malnory, which describes a dough mold; 4,522,580, issued in the name of Poister, which describes a dough roller and shaper device for pie crusts and the like; and 5,303,473, issued in the name of Sadler, which describes a cookie cutter.

Typically if a baker wishes to create various dough cutouts, numerous individual dough cutters must be collected, stored, retrieved, and used. This creates difficulties in storage and organization for a large number of cutters. Additionally, traditional dough cutters provide small handles or are utilized with a standard rolling pin, which are awkward and uncomfortable during repeated use and create additional storage difficulties. Attempts to solve for these disadvantages can be seen by reference to several U.S. Pat. No. 4,345,516, issued in the name of Sinclair, describes a cooking and cutting implement comprising a hollow cylindrical ring with a cutting edge for cutting circular shapes and a flat edge for cooking an egg within the ring and a handle supported on the edge of the ring. U.S. Pat. No. 4,384,838, issued in the name of Laughlin, describes a pie cutting and decorating apparatus for decoratively impressing a top crust for a filled pie comprising a flat annular plate with a cutting rim on an underside and a handle that projects outward from the plate. U.S. Pat. No. 6,381,852, issued in the name of Wallays, et al., describes a pastry cutter set with combined storage case and support comprising a plurality of cutter suitable for stamping shapes into rolled pastry dough and a storage case that provides a means to stack and store the cutters.

Additionally, ornamental designs for dough cutting devices exist, particularly, U.S. Pat. Nos. D 282,893; D 303,474; D 304,403; D 307,371; and D 311,117. However, none of these designs are similar to the present invention.

While these devices fulfill their respective, particular objectives, each of these references suffers from one (1) or more of the aforementioned disadvantages. Accordingly, there exists a need for a means by which bakers can provide their pies with aesthetic qualities that help to differentiate their pies from others. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide a simple device for cutting or stamping various decorative shapes in pastry dough in a comfortable manner for repeated use and to provide a plurality of cutting templates that improves storage and organizational difficulties and thus, the object of the present invention is to solve the aforementioned disadvantages and provide for this need.

To achieve the above objectives, it is an object of the present invention to provide a decorative pie crust press for cutting a variety of decorative shapes from rolled pie crust dough, which are added to a pie crust top surface prior to baking.

Another object of the decorative pie crust press is to provide a device comprising an ergonomic handle, a cutter platen that is removably attached to the handle via a two-part fastening means, and a plurality of interchangeable decorative cutting implements that are attached to the cutter platen.

Yet still another object of the decorative pie crust press is to provide an ergonomic handle comprising a plurality of finger reliefs and a means to engage the fastening means comprising a cavity, a button, two (2) communicative rod sections, a spring, a sphere portion, and a second fastening feature.

Yet still another object of the decorative pie crust press is to provide a fastening means comprising a two-part sliding fastener assembly that provide a means of removably securing a handle to a platen. A second fastening feature located on a lower end of the handle slidingly engages a first fastening feature located on an upper surface of the platen. A sphere portion of the locating mechanism located in the second fastening mechanism is in mechanical communication to a digit actuated button and engages a detent located in the first fastening mechanism provides a means of disengaging the fastening means and removing the handle from the platen.

Yet still another object of the present invention is to provide a plurality of decorative cutting blades that easily attach and detach from the platen that provide various alternative dough cutting shapes.

Yet still another object of the present invention is to provide a method of utilizing the device comprising generally of prepared a pie crust is in a normal manner and rolling it out to approximately one-quarter (¼) of an inch thick and positioning the device over the dough and pressing completely through the dough creating consistent decorative dough cutouts for placement upon a pie surface.

Yet still another object of the present invention is to provide a method of utilizing the device which provides users the ability to place perfectly sized and proportioned decorative elements on pie crusts in a manner that is not only quick and easy, but produces appealing and appetizing pies as well.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols and in which:

DESCRIPTIVE KEY

Figure 1:
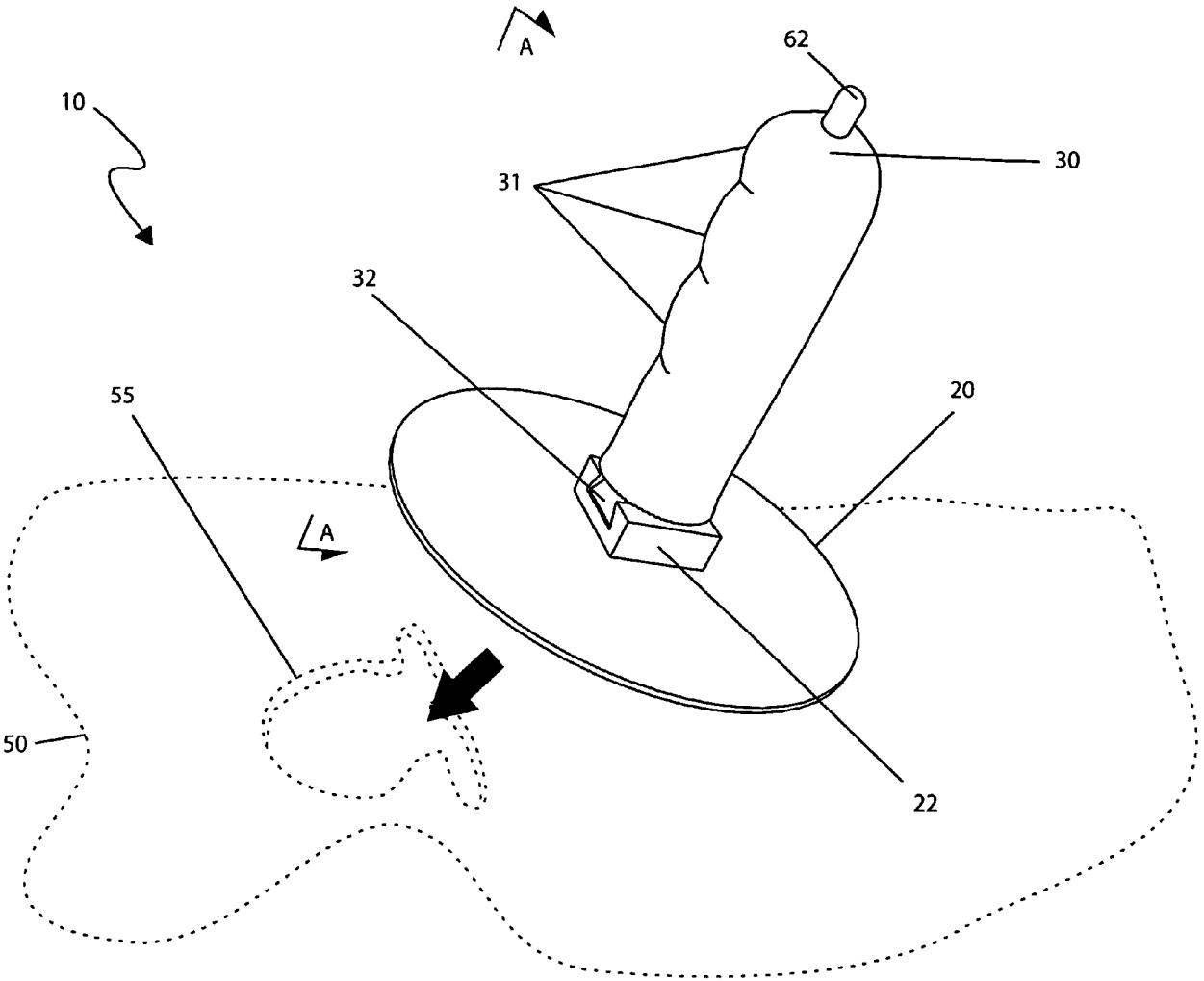
FIG. 1 is a perspective view of a decorative pie crust press 10 depicting an in-use state, according to a preferred embodiment of the present invention.

| | |
|---|---|
| 10 | decorative pie crust press |
| 20 | platen |
| 21 | first cutter |
| 22 | first fastener |
| 23 | detent |
| 24 | second cutter |
| 30 | handle |
| 31 | finger relief |
| 32 | second fastener |

-continued

| | |
|---|---|
| 33 | locating mechanism |
| 40 | third cutter |
| 41 | fourth cutter |
| 42 | fifth cutter |
| 43 | sixth cutter |
| 44 | seventh cutter |
| 45 | eighth cutter |
| 50 | dough |
| 55 | cut dough portion |
| 60 | spring |
| 62 | button |
| 65 | sphere portion |
| 70 | cavity |
| 80 | first rod |
| 85 | second rod |

DETAILED DESCRIPTION OF THE PREFERRED EMBODIMENT

The best mode for carrying out the invention is presented in terms of its preferred embodiment, herein depicted within FIGS. 1, 2*a*, 3 and 4, and in terms of an alternate embodiment with FIGS. 2*b* through 2*h*. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a decorative pie crust press (herein described as the "device") 10, for cutting a variety of decorative shapes therefrom rolled pie crust dough 50 to be added to a pie crust top surface prior to baking. Said device 10 comprises an ergonomic handle 30 being interchangeably attached thereto a plurality of dough cutter blades having different decorative patterns. The pie crust 50 is prepared in a normal manner being rolled out to approximately one-quarter (¼) of an inch thick. Next, the device 10 is positioned over the dough 50 and pressed completely therethrough. Finally, the cut dough portion 55 is deposited thereupon a pie and baked in a normal manner. It is anticipated that other types of pastry dough may be decorated with the use of the present device 10.

Referring now to FIG. 1, a perspective view of the device 10 depicting an in-use state, according to the preferred embodiment of the present invention, is disclosed. The device 10 comprises a cutter platen 20, a first fastener 22, a handle 30 with a plurality of finger reliefs 31, a second fastener 32, and a button 62. Said device 10 provides a removably attachable handle portion 30, thereby providing an attachment means thereto a plurality of cutter platens 20 via engagement between the first 22 and second 32 fasteners (see FIG. 3).

The device 10 comprises one (1) or more cutter platens 20. Each cutter platen 20 comprises rigid circular plastic forms approximately three (3) to six (6) inches in diameter and approximately one (1) millimeter thick being produced in a plastic molding process. Each cutter platen 20 comprises an integrally molded decorative cutter blade 21 along a lower surface (see FIGS. 2*a* and 2*b*).

The handle 30 comprises a form-fitting ergonomic shape having a plurality of finger reliefs 31 along a single side surface providing a user an improved gripping means. Said handle 30 also comprises a digit-operated button 62 which is located on a top distal portion. Said button 62 provides a fastening and unfastening means for the handle 30 to a desired platen 20 (also see FIG. 4). The handle 30 and button 62 are fabricated from rugged materials such as plastic, metal, wood, or the like.

Figure 2A:
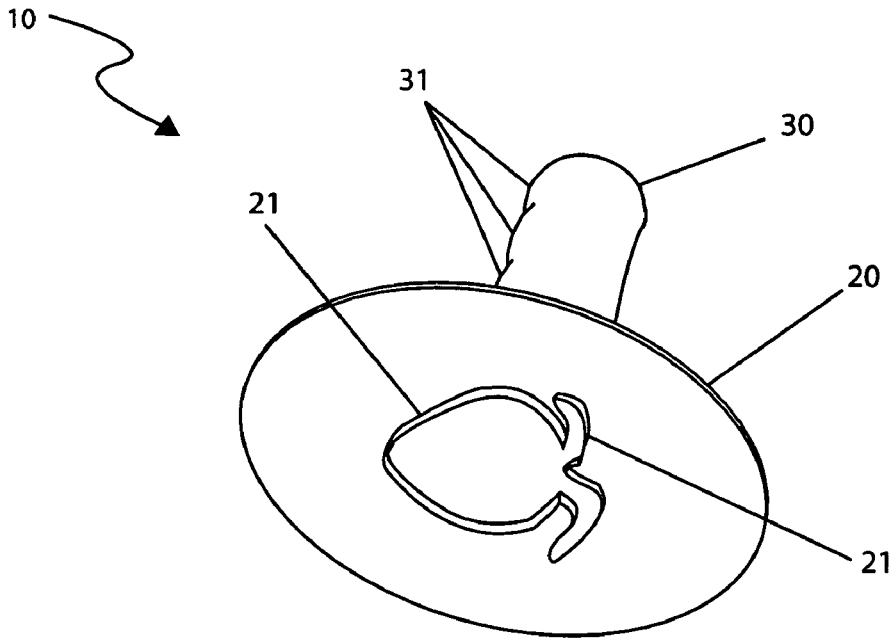
FIG. 2*a* is an upward-looking view of the decorative pie crust press 10 with a first cutter 21, depicting a strawberry-shaped design, according to a preferred embodiment of the present invention.
Figure 2B:
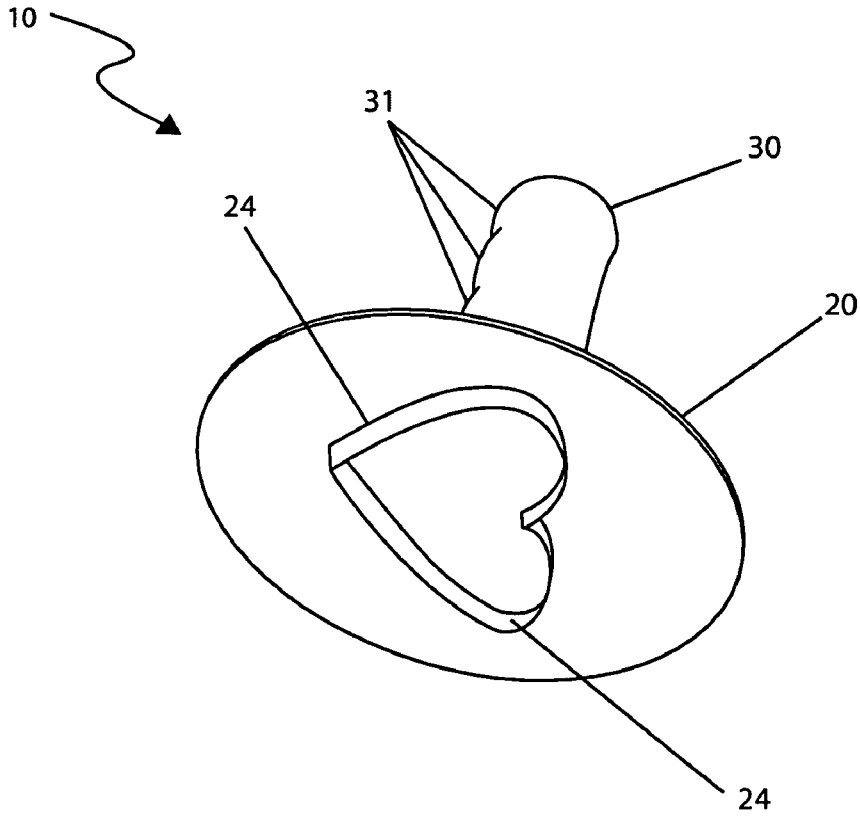
FIG. 2*b* is an upward-looking view of the decorative pie crust press 10 with a second cutter 24, depicting a heart-shaped design, according to an alternate embodiment of the present invention.

Referring now to FIGS. 2*a* and 2*b*, upward-looking views of the device 10 depicting a first cutter design 21 and a second cutter design 24, illustrated herein depicting a strawberry-shaped and a heart-shaped design, respectively, according to a preferred embodiment of the present invention, are disclosed. The device 10 comprises a plurality of cutter platens 20, each providing respective integrally molded cutter blades 21, 24 further comprising different decorative designs (two (2) examples shown here). Each cutter blade feature 21, 24 provides a cutting and extraction means thereto a cut dough portion 55 and is located along a lower horizontal surface of said cutter platen 20 extending perpendicularly downward therefrom approximately one-quarter (¼) inch and being approximately one (1) millimeter thick. The cutter blades 21, 24 comprise one (1) or more joined cutting elements producing a variety of cut dough portion shapes 55 such as religious symbols, holiday figures, pie type indices, or the like.

Figure 2C:
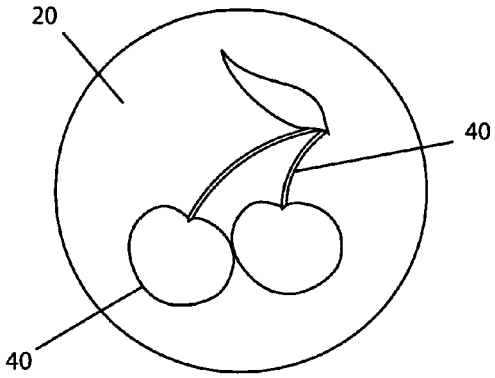
FIG. 2*c* is a front view of the decorative pie crust press 10 with a third cutter 40, depicting a heart-shaped design, according to an alternate embodiment of the present invention.
Figure 2D:
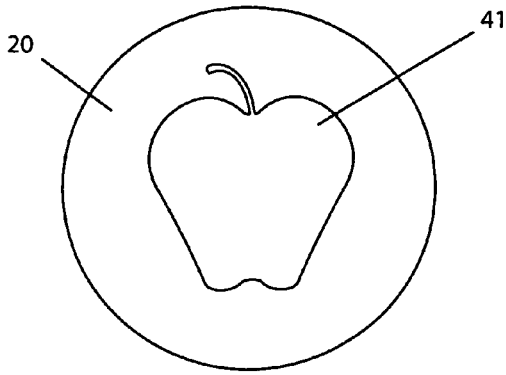
FIG. 2*d* is a front view of the decorative pie crust press 10 with a fourth cutter 41, depicting a heart-shaped design, according to an alternate embodiment of the present invention.
Figure 2E:
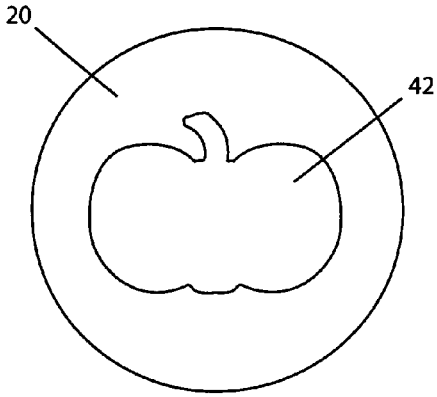
FIG. 2*e* is a front view of the decorative pie crust press 10 with a fifth cutter 42, depicting a heart-shaped design, according to an alternate embodiment of the present invention.
Figure 2F:
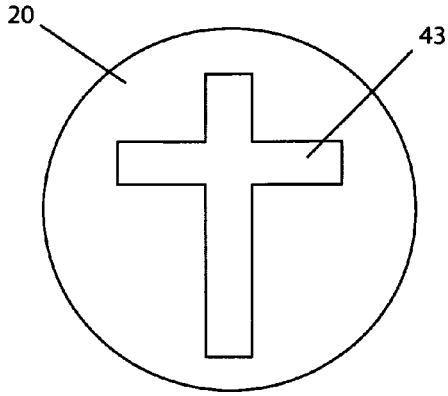
FIG. 2*f* is a front view of the decorative pie crust press 10 with a sixth cutter 43, depicting a heart-shaped design, according to an alternate embodiment of the present invention.
Figure 2G:
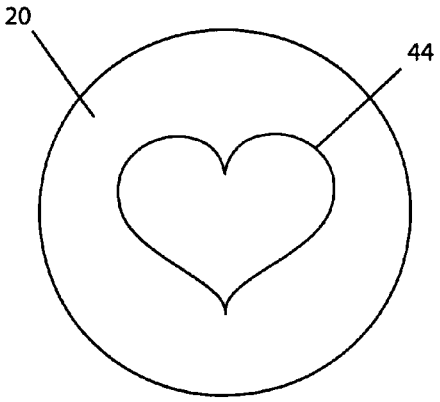
FIG. 2*g* is a front view of the decorative pie crust press 10 with a seventh cutter 44, depicting a heart-shaped design, according to an alternate embodiment of the present invention.
Figure 2H:
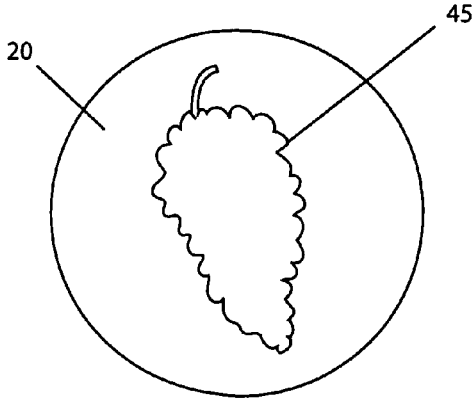
FIG. 2*h* is a front view of the decorative pie crust press 10 with an eighth cutter 45, depicting a heart-shaped design, according to an alternate embodiment of the present invention.

Referring now to FIGS. 2*c* through 2*h*, front views of various cutter designs, according to an alternate embodiment of the present invention, are disclosed. The cutter platens 20 may also comprise a means to make surface impressions therein the cut dough portions 55 via various protruding elements formed therealong a lower surface which when pressed therein said pie dough 50 result in various additional concave or recessed symbols and/or indicia. FIG. 2*c* depicts a third cutter 40 illustrated as a pair of cherries, FIG. 2*d* depicts a fourth cutter 41 illustrated as an apple, FIG. 2*e* depicts a fifth cutter 42 illustrated as a pumpkin, FIG. 2*f* depicts a sixth cutter 43 illustrated as a cross, FIG. 2*g* depicts a seventh cutter 44 illustrated as a heart, and FIG. 2*h* depicts an eighth cutter 45 illustrated as a group of lilacs.

Figure 3:
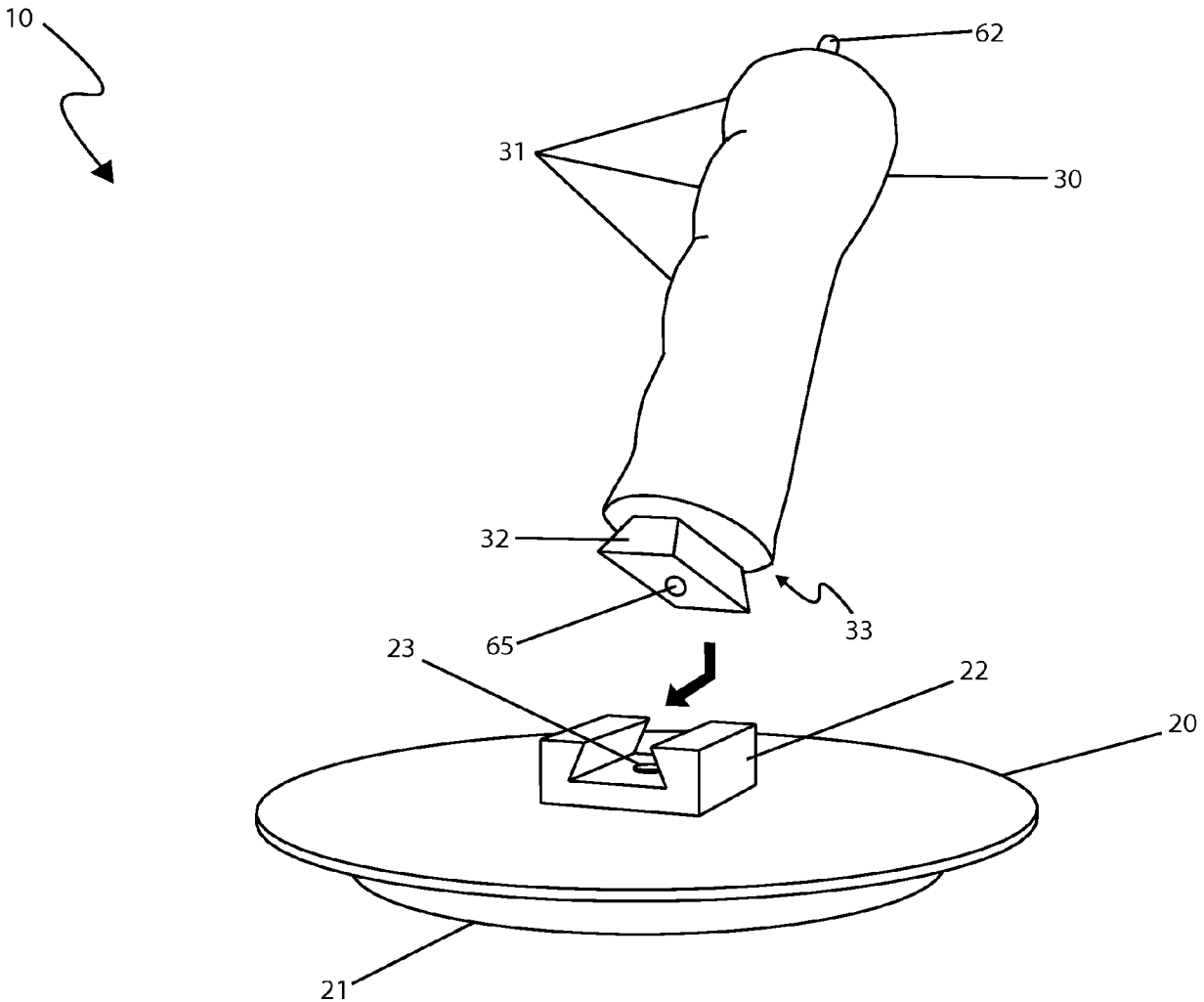
FIG. 3 is an exploded perspective view of the decorative pie crust press 10, according to a preferred embodiment of the present invention; and, FIG. 4 is a cross-sectional view of the decorative pie crust press 10 taken along line A-A as shown thereon FIG. 1, according to a preferred embodiment of the present invention.
Figure 4:
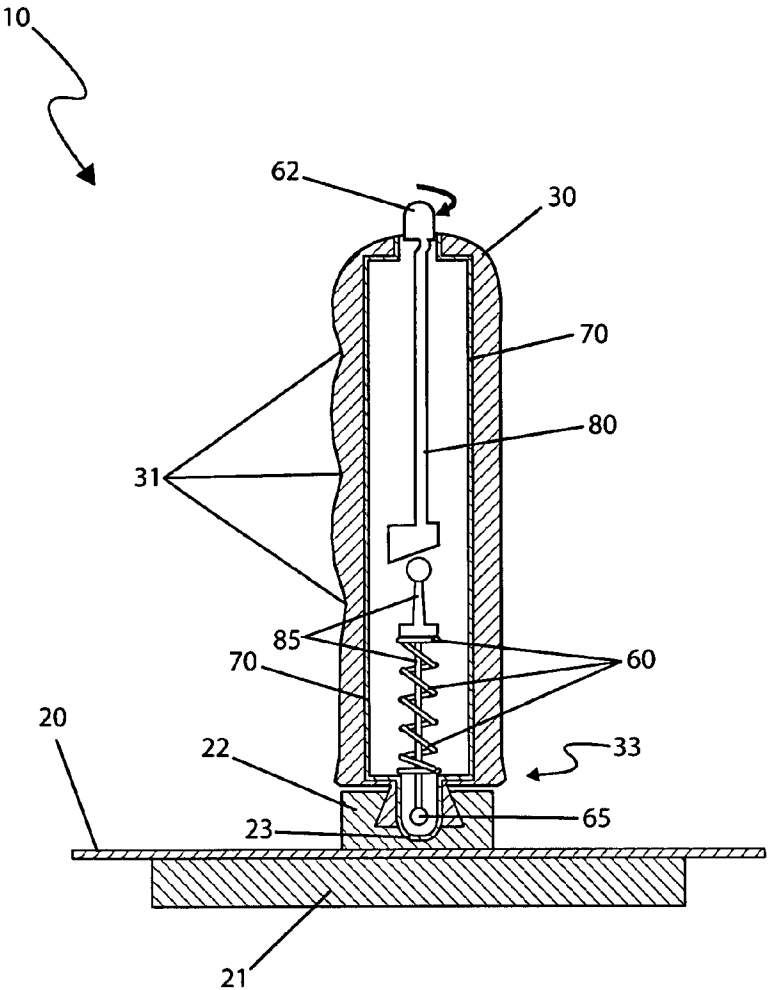

Referring now to FIG. 3, an exploded perspective view of the device 10 and FIG. 4, a cross-sectional view of the device 10 taken along line A-A as shown thereon FIG. 1, according to a preferred embodiment of the present invention, are disclosed. The device 10 comprises a first fastener 22, a detent 23, a second fastener 32, a locating mechanism 33, a spring 60, a button 62, a sphere portion 65, a cavity 70, a first rod 80, and a second rod 85. The fasteners 22, 32 provide a sliding engagement thereinto each other, thereby securing the cutter platen 20 thereto the handle portion 30. Said first 22 and second 32 fasteners are illustrated here having complementary tongue and groove elements; however, it is understood that other fastening designs may be introduced providing captivating edge features with equal benefit and as such should not be interpreted as a limiting factor of the invention.

A spring-loaded locating mechanism 33 being internally affixed therealong a central axis of the handle 30 provides a stationary relative position therebetween the fasteners 22, 32. The locating mechanism 33 comprises a spring 60, a button 62, a sphere portion 65, a lower rod 80, and a second rod 85. Said locating mechanism 33 fastens and unfastens the handle 20 to a platen 20. The button 62 portion of the locating mechanism 33 is located thereon a top distal portion of the handle 30 and is connected to a first rod portion 80. The first rod 80 is positioned at an intermediate location therein the cavity 70 and extends downwardly to an approximate length. An end portion of the first rod 80 takes the form of a rectangular shape comprising an angled bottom portion, thereby allowing the first rod 80 to engage a top sphere-shaped portion of a second rod 85. A lower distal portion of the second rod 85 comprises the sphere portion 65, thereby providing the attachment means to the desired platen 20. Said sphere portion 65 is secured into the detent 23 via an interference means which is discussed in further detail herein below. The second rod 85 also comprises two (2) rectangular portions spaced an appropriate gap to enable the position of and secure a spring 60 therebetween. The spring 60 provides a mechanical resistance device as the button 62 is depressed for fastening and unfastening. In use, the button 62 is rotated ninety degrees (90°) and depressed to engage the second rod 85 and fasten the handle 30 to the platen 20. When the second rod 85 is engaged it is forced downwardly, depressing the spring 60, and driving the sphere portion 65 thereinto the detent 23. The locating mechanism 33 is shown here comprising a common spring-loaded ball plunger; however, other spring-loaded, digit-released actuating components may be used to provided equivalent locking of the cutter platen 20 thereto the handle 30 and as such should not be interpreted as a limiting factor of the invention.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: acquiring the device 10; preparing a quantity of pie crust dough 50; rolling the dough 50 to a thickness of approximately one-quarter (¼) inch; selecting a particular cutter platen 20 having a desired cutter blade design 21, 24; mounting the selected cutter platen 20 thereto the handle 30 by engaging the first 22 and second 32 fasteners; sliding said first 22 and second 32 fasteners together which aligns the cavity 70 with the detent 23; rotating the button 62; depressing the button 62, thereby depressing the second rod 85, enabling the spring 60 to also depress, and securing the sphere portion 65 thereinto the detent 23; grasping the handle portion 30; pressing the cutter blade 21 portion of the device 10 thereinto the rolled dough 50; lifting the device 10, thereby extracting a cut dough portion 55 therefrom the rolled dough 50; positioning the device 10 and included cut dough portion 55 over a pie; separating the cut dough portion 55 therefrom the device 10; placing the cut dough portion 55 thereonto a top surface of the pie; cutting and adding additional cut dough portions 55 having a same or alternate design 24; baking the pie in a normal manner; rotating the button 62 and depressing said button 62, thereby depressing the second rod 85 and spring 60, and releasing the sphere portion 65 thereon the handle 30 from the detent 23; utilizing as necessary; and, enjoying an enhanced decorative appearance of a pie using the device 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A pastry press comprising:

a handle;

a cutter platen removably attached to said handle with a first fastener located on an upper surface of said cutter platen correspondingly mating with a second fastener located on said handle, thereby fastening and securing said handle to said cutter platen;

a decorative cutting implement disposed on said cutter platen; and, a locating mechanism internally affixed along a central axis of said handle and further comprises:

a cavity extending from a top distal portion of said handle to said second fastener;

a button located at said top distal portion;

a first rod attached at a first upper end to said button, is positioned at an intermediate location in said cavity, is extending downwardly, and having a first lower end;

a second rod having a second upper end engaging said first lower end and further comprising a second lower end having a pair of rectangular portions defining a gap therebetween;

a spring secured between said pair of rectangular portions;

a sphere portion, having a sphere upper end engaging said second lower end and a sphere lower end; and, a detent located at an upper surface of said first fastener for correspondingly receiving said lower sphere end;

wherein said operation of said button alternates securing and unfastening said handle upon subsequent depressions;

wherein said spring provides a mechanical resistance as said button is depressed; and wherein said sphere portion extends from a bottom opening of said cavity to engage said detent; and, wherein said cutter platen is interchangeable with another cutter platen having a different decorative cutting implement.

2. The pastry press of claim 1, wherein said handle is a rigid and resilient elongated member further comprising a plurality of finger reliefs along a single side surface.

3. The pastry press of claim 1, wherein said cutter platen further comprises a rigid circular form, wherein said decorative cutting implement is integrally formed along a lower surface of said cutter platen and outwardly extending therefrom.

4. The pastry press of claim 1, wherein said cutter platen comprises a diameter in the range of three to six inches and a thickness of approximately one millimeter.

5. The pastry press of claim 1, wherein said first fastener is a groove and said second fastener is a tongue.

6. The pastry press of claim 1, wherein said decorative cutting implement is a shape simulating a pair of cherries.

7. The pastry press of claim 1, wherein said decorative cutting implement is a shape simulating an apple.

8. The pastry press of claim 1, wherein said decorative cutting implement is a shape simulating a pumpkin.

9. The pastry press of claim 1, wherein said decorative cutting implement is a shape simulating a cross.

10. The pastry press of claim 1, wherein said decorative cutting implement is a shape simulating a heart.

11. The pastry press of claim 1, wherein said decorative cutting implement is a shape simulating a plurality of lilacs.

* * * * *